US009004844B2

(12) United States Patent
Nishiwaki et al.

(10) Patent No.: US 9,004,844 B2
(45) Date of Patent: Apr. 14, 2015

(54) FORKLIFT TRUCK

(71) Applicant: Kabushiki Kaisha Toyota Jidoshokki, Kariya-shi, Aichi-ken (JP)

(72) Inventors: Takashi Nishiwaki, Aichi-ken (JP); Junichi Kuwayama, Aichi-ken (JP); Tadashi Yamada, Aichi-ken (JP)

(73) Assignee: Kabushiki Kaisha Toyota Jidoshokki, Aichi-ken (JP)

( * ) Notice: Subject to any disclaimer, the term of this patent is extended or adjusted under 35 U.S.C. 154(b) by 195 days.

(21) Appl. No.: 13/625,117

(22) Filed: Sep. 24, 2012

(65) Prior Publication Data

US 2013/0084153 A1 Apr. 4, 2013

(30) Foreign Application Priority Data

Sep. 29, 2011 (JP) ..... 2011-214451

(51) Int. Cl.
*B66F 9/20* (2006.01)
*B66F 9/24* (2006.01)
*B66F 9/08* (2006.01)

(52) U.S. Cl.
CPC . *B66F 9/082* (2013.01); *B66F 9/20* (2013.01); *B66F 9/24* (2013.01)

(58) Field of Classification Search
CPC ..... B66F 9/06
USPC ..... 414/636; 701/50; 700/213
See application file for complete search history.

(56) References Cited

U.S. PATENT DOCUMENTS

| | | | | |
|---|---|---|---|---|
| 4,459,081 | A * | 7/1984 | Reeves | 414/636 |
| 4,932,192 | A * | 6/1990 | Ishimaru | 56/11.8 |
| 6,092,976 | A * | 7/2000 | Kamiya | 414/636 |
| 7,320,385 | B2 | 1/2008 | Katae et al. | |
| 8,037,778 | B2 * | 10/2011 | Kazushi | 74/471 XY |
| 8,616,297 | B2 * | 12/2013 | Shintani et al. | 172/407 |
| 2001/0031196 | A1 | 10/2001 | Tanaka | |

FOREIGN PATENT DOCUMENTS

| | | | | |
|---|---|---|---|---|
| EP | 0791288 | A1 * | 8/1997 | A01D 34/68 |
| JP | 9-25099 | A | 1/1997 | |
| JP | 9-295800 | A | 11/1997 | |

(Continued)

OTHER PUBLICATIONS

Extended European Search Report for corresponding EP Patent Application No. 12185636.3 issued on Nov. 30, 2012.

*Primary Examiner* — Saul Rodriguez
*Assistant Examiner* — Ashley Romano
(74) *Attorney, Agent, or Firm* — Sughrue Mion, PLLC

(57) ABSTRACT

A forklift truck includes a truck body, a fork, a mast, tilting and lifting mechanisms, tilt and lift levers, tilting and lifting operation detectors, an auxiliary switch, a tilt angle detector and a controller. The tilt and lift levers are adapted to operate the tilting and lifting mechanisms, respectively. The auxiliary switch is disposed on the lift lever at a position where the auxiliary switch and the lift lever are operable by the same operator's hand. The controller is adapted to control the tilting and lifting mechanisms based on signals from the tilting and lifting operation detectors and the auxiliary switch. When the auxiliary switch is in operative position and the lifting operation detector detects that the lift lever is in operative position, the controller controls the tilting mechanism so as to tilt the fork to have a predetermined tilt angle based on a signal from the tilt angle detector.

4 Claims, 5 Drawing Sheets

(56) References Cited

FOREIGN PATENT DOCUMENTS

| | | | |
|---|---|---|---|
| JP | 2003-089500 | A | 3/2003 |
| JP | 2003-212489 | A | 7/2003 |
| JP | 2009-288872 | A | 12/2009 |
| JP | 2010-095327 | A | 4/2010 |

* cited by examiner

FORKLIFT TRUCK

BACKGROUND OF THE INVENTION

The present invention relates to a forklift truck having a tilting mechanism and a lifting mechanism.

A forklift truck is known which has a lifting mechanism that lifts or lowers a fork of the forklift truck for placing a load on a pallet onto a shelf and removing such load from the shelf. The forklift truck also has a tilting mechanism that tilts the fork frontward and rearward for preventing the load from falling off from the pallet. Japanese Patent Application Publication No. 9-295800 discloses a forklift truck equipped with a tilting mechanism having a leveling pushbutton switch which is operated to cause the fork being tilted to be stopped automatically when the fork reaches its horizontal position. Thus, the truck operator can move the fork to its horizontal position easily without making visual adjustment of the tilt angle of the fork.

In performing the loading and unloading operation while paying attention so as to prevent a load on the pallet from falling in the forklift truck disclosed by the above Publication, however, the operator is required to manipulate the tilt lever for controlling the tilting mechanism and the lift lever for controlling the lifting mechanism. When operating the tilting mechanism and the lifting mechanism simultaneously, the operator is required to manipulate the tilt lever and the pushbutton switch with one hand and to operate the lift lever with the other hand. Thus, the operator is required to manipulate the pushbutton switch while the operator manipulates the two levers simultaneously with both hands and, therefore, the forklift truck suffers from poor workability of the forklift truck. The operator may manipulate each of the levers with one hand to operate the tilting mechanism and the lifting mechanism separately. In this case, the operator is not required to operate the two levers at the same time or the operator may operate the two levers with one hand in turn. However, the operator needs to operate the two levers in turn or in two different steps, so that the problem of poor working efficiency of the forklift truck remains.

The present invention which has been made in light of such problems is directed to providing a forklift truck which improves the working efficiency in operating the lifting mechanism and the tilting mechanism simultaneously.

SUMMARY OF THE INVENTION

In accordance with the present invention, a forklift truck includes a truck body, a fork and a mast movable to be lifted, lowered and tilted together with the fork, a tilting mechanism, a tilt lever, a tilting operation detector, a lifting mechanism, a lift lever, a lifting operation detector, an auxiliary switch, a tilt angle detector and a controller. The tilting mechanism is adapted to tilt the mast relative to the truck body. The tilt lever is adapted to operate the tilting mechanism. The tilting operation detector detects whether or not the tilt lever is in operative position. The lifting mechanism is adapted to lift and lower the fork along the mast. The lift lever is adapted to operate the lifting mechanism. The lifting operation detector detects whether or not the lift lever is in operative position. The auxiliary switch is disposed on the lift lever at a position where the auxiliary switch and the lift lever are operable by the same hand of an operator of the forklift truck. The tilt angle detector detects a tilt angle of the mast. The controller is adapted to control the tilting mechanism and the lifting mechanism based on signals from the tilting operation detector, the lifting operation detector and the auxiliary switch.

When the auxiliary switch is in operative position and the lifting operation detector detects that the lift lever is in operative position, the controller controls the tilting mechanism so as to tilt the fork to have a predetermined tilt angle based on a signal from the tilt angle detector.

Other aspects and advantages of the invention will become apparent from the following description, taken in conjunction with the accompanying drawings, illustrating by way of example the principles of the invention.

BRIEF DESCRIPTION OF THE DRAWINGS

The invention together with objects and advantages thereof, may best be understood by reference to the following description of the presently preferred embodiments together with the accompanying drawings in which.

DETAILED DESCRIPTION OF THE PREFERRED EMBODIMENTS

Figure 1:
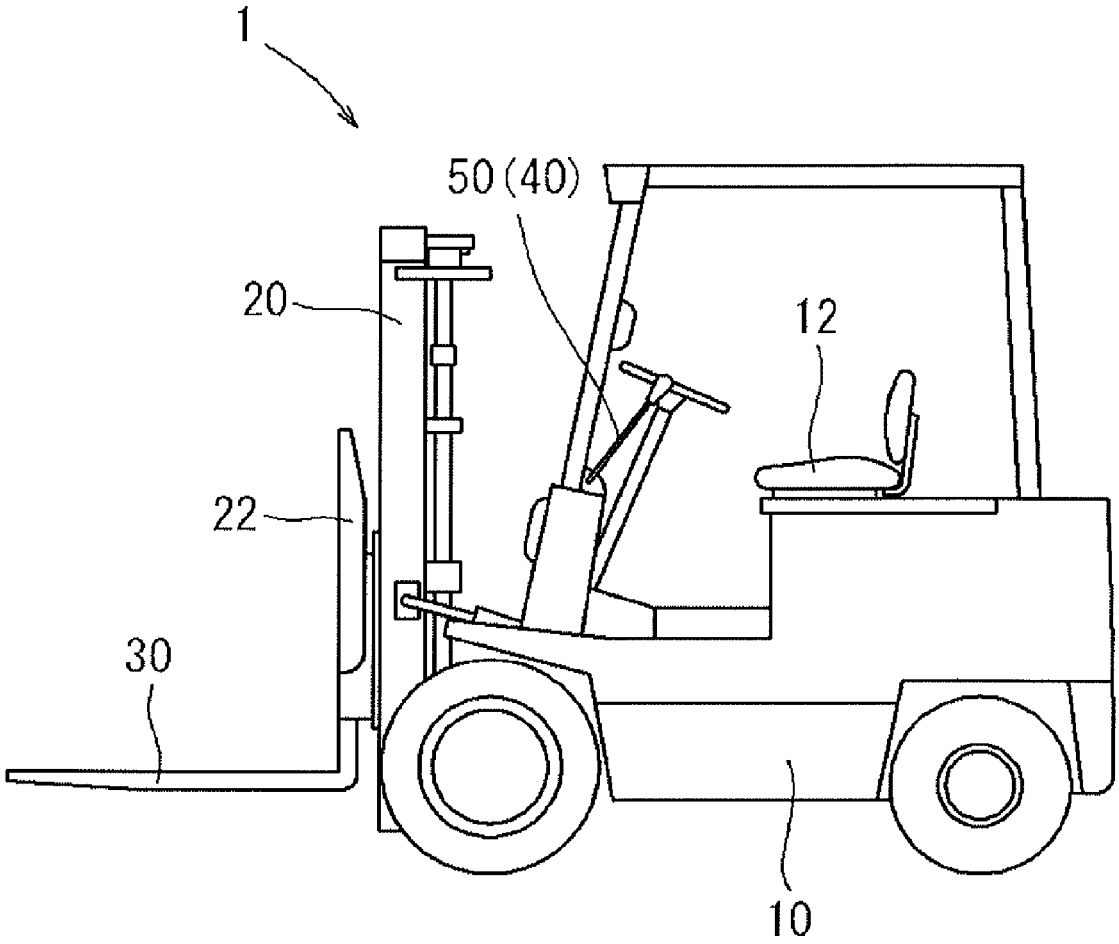
FIG. 1 is a schematic side view of a forklift truck according to a first preferred embodiment of the present invention.
Figure 2:
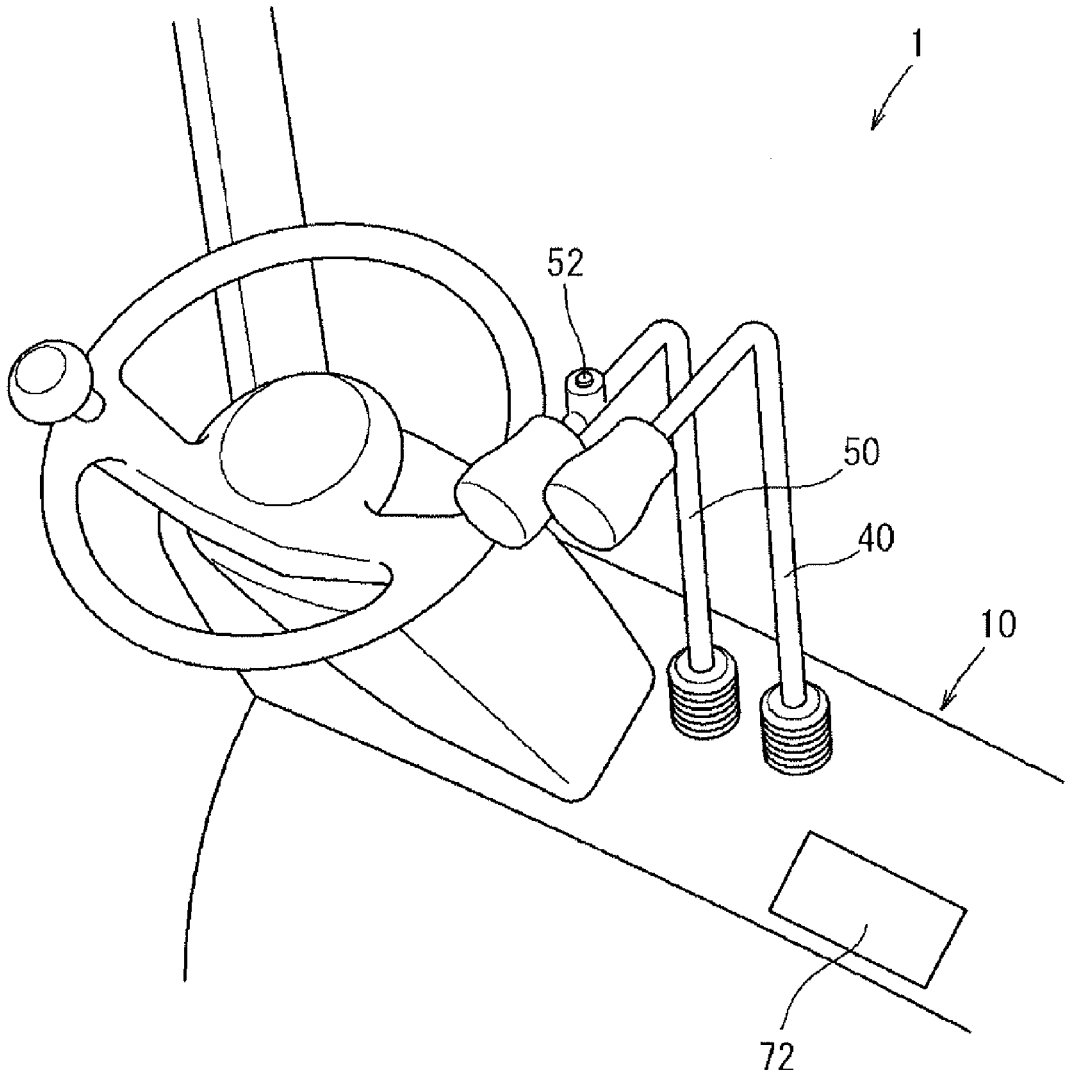
FIG. 2 is a partially enlarged perspective view of an operator's platform of the forklift truck of FIG. 1.
Figure 3:
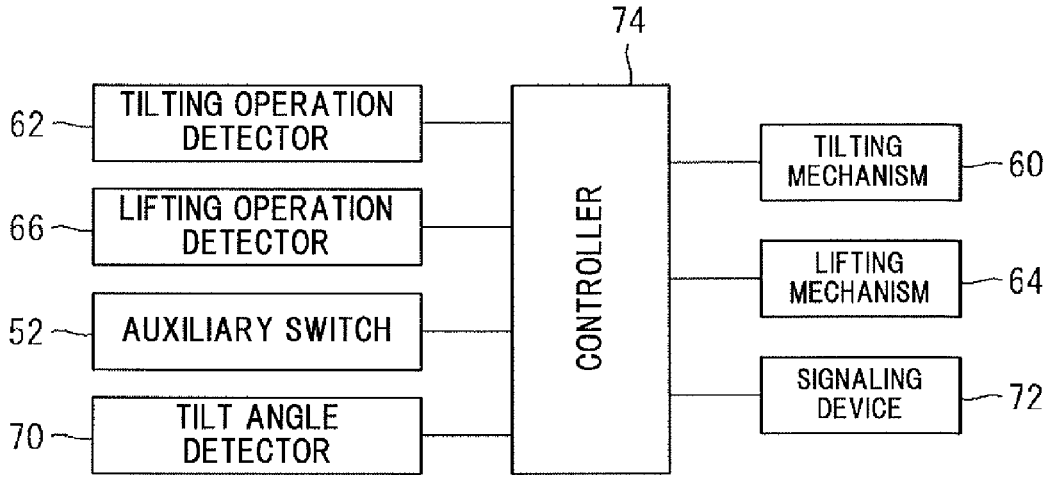
FIG. 3 is a block diagram showing the electrical arrangement of the forklift truck of FIG. 1.

The following will describe a forklift truck according to a first preferred embodiment of the present invention with reference to FIGS. 1 through 4. Referring to FIGS. 1 through 3, the reference numeral 1 designates a forklift truck of the first preferred embodiment of the present invention. The following will describe the mechanical configuration and the electrical configuration of the forklift truck 1 separately. In the following description of the first preferred embodiment of the present invention, "predetermined angle" of a fork 30 of the forklift truck 1 means the angle of the fork 30 at which the fork 30 is set level or horizontal respect to the ground and state of the fork 30 in which the fork 30 is placed in its horizontal position will be referred to as "horizontal position". During loading operation of the forklift truck 1, the fork 30 is tilted to its horizontal position when picking up a load from a shelf. Thus, tilting of the fork 30 to the horizontal position is performed frequently during the loading operation. When a load is picked up from the shelf by the forklift truck 1, the fork 30 is tilted to the horizontal position. The fork 30 is frequently tilted to the horizontal position in loading operation.

The following will describe the mechanical configuration of the forklift truck 1 with reference to FIGS. 1 and 2. The forklift truck 1 includes a truck body 10, a mast 20 supported tiltably about a transverse axis of the truck body 10 and a fork 30 movable to be lifted and lowered through a lift bracket 22 relative to the mast 20.

The truck body 10 includes a tilt lever 40 and a lift lever 50 which are operable by an operator seated on an operator's seat 12. The forklift truck 1 includes a tilting mechanism in which the mast 20 is tiltable about a transverse axis of the truck body 10 by operating the tilt lever 40. The forklift truck 1 includes a lifting mechanism in which the fork 30 is movable to be lifted and lowered through the lift bracket 22 relative to the mast 20 by operating the lift lever 50. These tilting and lifting mechanisms 60, 64 will be described in detail later.

Referring to FIG. 3, the following will describe the electrical configuration of the forklift truck 1. The forklift truck 1 includes the aforementioned tilting mechanism 60, a lifting mechanism 64, a tilting operation detector 62, a lifting operation detector 66, an auxiliary switch 52, a tilt angle detector 70, a signaling device 72, a controller 74 which are all electrically connected to the controller 74.

The tilting mechanism 60 is used for tilting the mast 20 about a transverse axis of the truck body 10 and includes a tilt cylinder (not shown) connected to the mast 20, a pump supplying pressurized oil to the tilt cylinder, a motor driving the pump and an electromagnetic valve operable to adjust the amount of the pressurized oil to be supplied to the tilt cylinder. It is noted that the pump and the motor are shared by the tilting mechanism 60 and the lifting mechanism 64 and used for supplying oil whose amount to be supplied to the tilt cylinder and the lift cylinder is adjusted by the electromagnetic valve and which is supplied to the tilt cylinder and the lift cylinder. The electromagnetic valve is electrically connected to the controller 74 and controlled by a signal from the controller 74.

Adjusting the amount of oil to be supplied to the tilt cylinder, the extension and retraction of the tilt cylinder and hence the tilting operation of the mast 20 is controlled. The mast 20 is tilted according to the retraction of the tilt cylinder such that the fork 30 has a predetermined tilt angle. The controller 74 controls the operation of electromagnetic valve thereby to control the tilting mechanism 60.

The tilting operation detector 62 is made of a lever switch and detects whether or not the tilt lever 40 is in operative position. The tilting operation detector 62 also detects the operation amount of the tilt lever 40. The tilting operation detector 62 is disposed adjacent to the bottom of the tilt lever 40 and electrically connected to the controller 74 which will be described later. The controller 74 receives from the tilting operation detector 62 signals indicative of the position (state) and the operation amount of the tilt lever 40.

The lifting mechanism 64 which is used for lifting and lowering the fork 30 along the mast 20 through the lift bracket 22. Specifically, the lifting mechanism 64 includes a lift cylinder operable to lift and lower the fork 30 along the mast 20, the aforementioned pump supplying pressurized oil to the lift cylinder, the aforementioned motor driving the pump and an electromagnetic valve operable to adjust the amount of oil to be supplied to the tilt cylinder. The operation of the electromagnetic valve is controlled by a signal from the controller 74. Adjusting the amount of oil to be supplied to the lift cylinder, the extension and retraction of the lift cylinder and hence the lifting and lowering operation of the fork 30 is controlled.

The lifting operation detector 66 is made of a lever switch and detects whether or not the lift lever 50 is placed in operative position. The lifting operation detector 66 also determines the operation amount of the lift lever 50. The lifting operation detector 66 is disposed adjacent to the bottom of the lift lever 50 and electrically connected to the controller 74. The controller 74 receives from the lifting operation detector 66 signals indicative of the position (state) of the lift lever 50 and the operation amount of the lift lever 50.

The auxiliary switch 52 is made, for example, of a switch which may be kept closed only while the switch is held pressed and used for activating an automatic leveling mechanism which will be described later. As shown in FIG. 2, the auxiliary switch 52 is disposed adjacent to a knob of the lift lever 50 that is formed at the end of the lift lever 50 and has an enlarged diameter. The auxiliary switch 52 is located at a position where the auxiliary switch 52 and the lift lever 50 may be operable by the operator with the same hand, for example at a position of the lift lever 50 adjacent to its knob, as shown in FIG. 2. Alternatively, the auxiliary switch 52 may be located on the knob itself.

The auxiliary switch 52 is electrically connected to the controller 74. The controller 74 determines whether or not the auxiliary switch 52 is in operative position based on a signal from the auxiliary switch 52.

The tilt angle detector 70 is made of, for example, a potentiometer and detects the tilt angle of the fork 30 relative to its horizontal position. The tilt angle detector 70 is disposed in the tilting mechanism 60 on the truck body 10 side of the tilt cylinder and electrically connected to the controller 74. The controller 74 receives from the tilt angle detector 70 a signal that is indicative of the tilt angle of the mast 20 to detect the tilt angle of the fork 30. The controller 74 determines in real time whether the fork 30 is in its frontward position, its horizontal position or its rearward position based on the signal from the tilt angle detector 70.

The signaling device 72 is provided by a buzzer which is activated when the fork 30 is tilted to its horizontal position for signaling the operator of the fork 30 being tilted to its horizontal position. The signaling device 72 is disposed adjacent to the operator's seat 12 of the truck body 10 and electrically connected to the controller 74. The controller 74 causes the signaling device 72 to be activated for signaling the operator that the fork 30 is tilted to its horizontal position.

The controller 74 controls loading and traveling of the forklift truck 1 and controls the tilting mechanism 60, the tilting operation detector 62, the lifting mechanism 64, the lifting operation detector 66, the auxiliary switch 52, the tilt angle detector 70 and the signaling device 72 as shown in FIG. 2. The controller 74 includes an electronic control unit (ECU) and a read only memory (ROM) storing therein programs which will be described in detail later. According to the program, the controller 74 determines whether or not the tilt lever 40 is in operative position based on a signal from the tilting operation detector 62 and also the operation amount of the tilt lever 40 and outputs a signal for controlling the tilting mechanism 60 which may be provided by an electromagnetic valve. Thus, according to the operation amount of the tilt lever 40 operated by the operator, the fork 30 is controlled to be tilted frontward or rearward. Similarly, the controller 74 also determines whether or not the lift lever 50 is in operative position base on a signal from the lifting operation detector 66 and the operation amount of the lift lever 50 and outputs a signal for controlling the lifting mechanism 64 which may be provided by an electromagnetic valve. According to the operation amount of the lift lever 50 operated by the operator, the fork 30 is controlled to be lifted and lowered.

The controller 74 also stores therein a second program. The second program is used for performing the automatic fork leveling function which causes the fork 30 being tilted to be stopped at its horizontal position.

Figure 4:
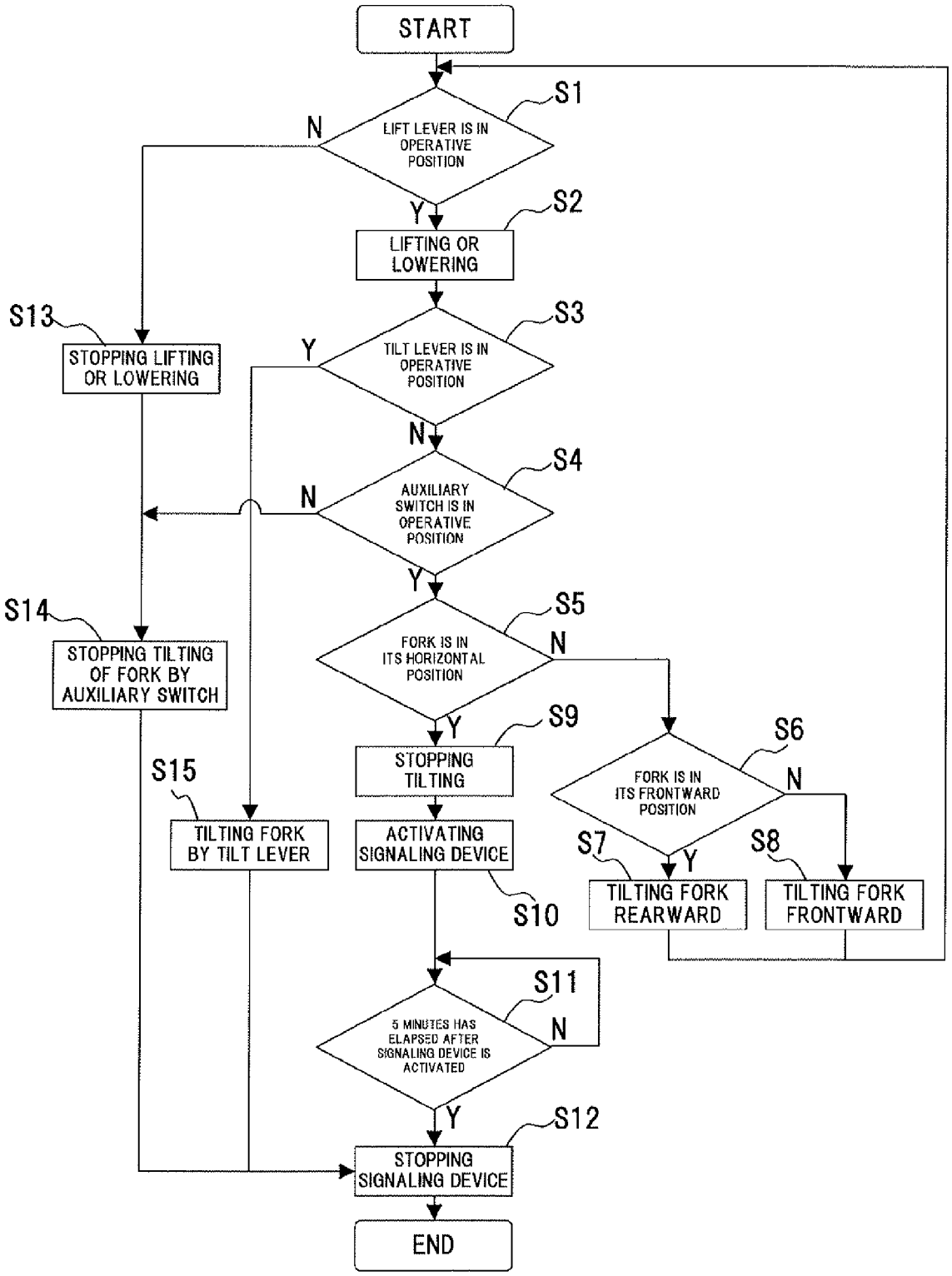
FIG. 4 is a flow chart illustrating the operation of the automatic fork leveling function of the forklift truck of FIG. 1.

Referring to FIG. 4, the following will describe the operation of the automatic fork leveling function of the forklift truck 1 according to the second program. Receiving a detection signal from the lifting operation detector 66, the controller 74 determines at step S1 whether or not the lift lever 50 is in operative position. If YES at step S1, the controller 74 controls the lifting mechanism 64 so as to lift the fork 30 depending on the operation amount of the lift lever 50, at step S2.

Receiving a detection signal from the tilting operation detector 62, the controller 74 determines at step S3 whether or not the tilt lever 40 is in operative position. If NO at step S3, the controller 74 determines at step S4 whether or not the auxiliary switch 52 is in operative position. If YES at step S4, the controller 74 determines at step S5 whether or not the fork 30 is in its horizontal position based on a signal from the tilt angle detector 70. If NO at step S5, the controller 74 determines at step S6 whether or not the fork 30 is tilted frontward.

If YES at step S6, the controller 74 controls the tilting mechanism 60 at step S7 so as to tilt the fork 30 rearward and then the process is returned to step S1. If NO at step S6, the controller 74 controls the tilting mechanism 60 at step S8 so as to tilt the fork 30 frontward and then the process is returned to step S1. Thereafter, if the lift lever 50 and the auxiliary switch 52 continue to be in their operative positions, the above-described steps S1 through S7, S8 are repeated until the controller 74 determines at step S5 that the fork 30 is in its horizontal position or YES determination is made at step S5. If YES at step S5, the controller 74 controls the tilting mechanism 60 at step S9 so as to stop the tilting movement of the fork 30. As described above, the controller 74 controls the tilting mechanism 60 based on a signal from the tilt angle detector 70 so as to tilt the fork 30 to its horizontal position.

When the fork 30 is tilted to its horizontal position, the controller 74 activates the signaling device 72 or a buzzer at step S10. Accordingly, the operator recognizes that the fork 30 is tilted to its horizontal position. The controller 74 then determines at step S11 whether or not a predetermined time, for example 5 minutes, has elapsed after the signaling device 72 is activated. If YES at step S11, the controller 74 stops the signaling device 72 at step S12 after 5 minutes has elapsed since the signaling device 72 is operated and then the whole process is ended. Thus, the fork 30 is set in its horizontal position and loading operation is performed by the operator.

The process is returned to step S1 and then the sequence is performed repeatedly.

If No determination is made at step S1 during the repetition of the steps S1 to S8 or the controller 74 determines at step S1 based on a signal from the lifting operation detector 66 that the operation of the lift lever 50 is in inoperative position, the controller 74 causes the fork 30 to stop its lifting or lowering at step S13 and then causes the fork 30 to stop its tilting at step S14. The process proceeds to step S12. As described above, when the lifting operation detector 66 detects that the lift lever 50 is in inoperative position from a state where the lift lever 50 is in operative position while the auxiliary switch 52 is kept in operative position, the controller 74 controls the tilting mechanism 60 so as to stop tilting of the fork 30.

If YES determination is made at step S3 during the repetition of steps S1 through S7 or S8 (or it is determined based on a signal from the tilting operation detector 62 that the tilt lever 40 is in operative position), the controller 74 controls the tilting mechanism 60 so as to tilt the fork 30 frontward or rearward depending on the operation amount of the tilt lever 40 at step S15, or the tilting operation is performed by the tilt lever 40. Then, the process proceeds to step S12. Thus, when the tilt lever 40 is operated during the automatic fork leveling operation, the manual fork tilting operation overrides the automatic fork leveling operation and thereafter the fork operation is performed according to the second program.

On the other hand, if NO determination is made at step S4 during the repetition of the steps S1 though S7 or S8, or the auxiliary switch 52 is placed in its inoperative position, the controller 74 causes the tilting operation by the tilting mechanism 60 to be stopped at step S14. When the operation of the auxiliary switch 52 is stopped, the operation by the tilting mechanism 60 is stopped and the operation by the lift lever 50 is performed. As described above, if the lifting operation detector 66 detects that the lift lever 50 is in operative position and the operation of the auxiliary switch 52 is stopped, the controller 74 stops the controlling of the tilting mechanism 60.

According to the forklift truck 1 of the first preferred embodiment, the auxiliary switch 52 is disposed at a position adjacent to the knob of the lift lever 50 where the auxiliary switch 52 and the lift lever 50 are operable by the operator with the same hand. By so disposing the auxiliary switch 52, the auxiliary switch 52 may be operated easily while the lift lever 50 is in operative position.

Depressing the auxiliary switch 52, the fork 30 may be tilted easily to its horizontal position while lifting or lowering the fork 30. Thus, switching the operation of the lifting mechanism to the tilting of the fork to its horizontal position may be performed by one hand, so that the working efficiency in the loading and unloading operation may be improved. Additionally, the operator is not required to operate the lift lever 50 and the tilt lever 40 sequentially in two different operations, so that the fork operating efficiency may be improved.

As described above, when the fork 30 is being tilted toward its horizontal position while lifting or lowering the fork 30, the controller 74 determines in real time based on a signal from the tilt angle detector 70 whether or not the fork 30 is in its horizontal position, forward position or rearward position and the extent to which the fork 30 is tilted frontward or rearward. According to the automatic fork leveling function, the controller 74 controls the tilting mechanism 60 so as to tilt the fork to its horizontal position based on the detection signal. The operator is not required to operate the tilt lever 40 differently depending on the tilted position, i.e. frontward or rearward, of the fork 30, but the operator may only operate the auxiliary switch 52 and concentrate on the loading operation without paying attention to the tilt angle of the fork 30. According to the automatic fork leveling function, the tilting operation is automatically stopped when the fork 30 is tilted to its horizontal position and then the signaling device 72 is energized, so that the operator may concentrate on the loading operation without performing any visual fine adjustment for the tilting of the fork 30.

According to the first preferred embodiment, if NO determination is made at step S1, during the repetition of the steps S1 through S7, S8 or when the fork tilting operation is performed while lifting or lowering the fork 30, the lifting or lowering of the fork 30 is stopped. Thus, when the fork 30 is being switched to its horizontal position while the fork 30 is lifted or lowered, the lifting or lowering of the fork 30 and tilting of the fork 30 toward its horizontal position may be stopped as required by the operator. The same is true for the case of NO determination at step S4. That is, if the auxiliary switch 52 is in operative position at step S4 during the repetition of the steps S1 through S7 or S8, the fork 30 is stopped. Thus, the tilting movement of the fork 30 toward its horizontal position while being lifted or lowered may be stopped as required by the operator.

When the fork 30 is tilted to its horizontal position, the signaling device 72 is activated. Thus, the operator can recognize that the fork 30 has tilted to its horizontal position.

Figure 5:
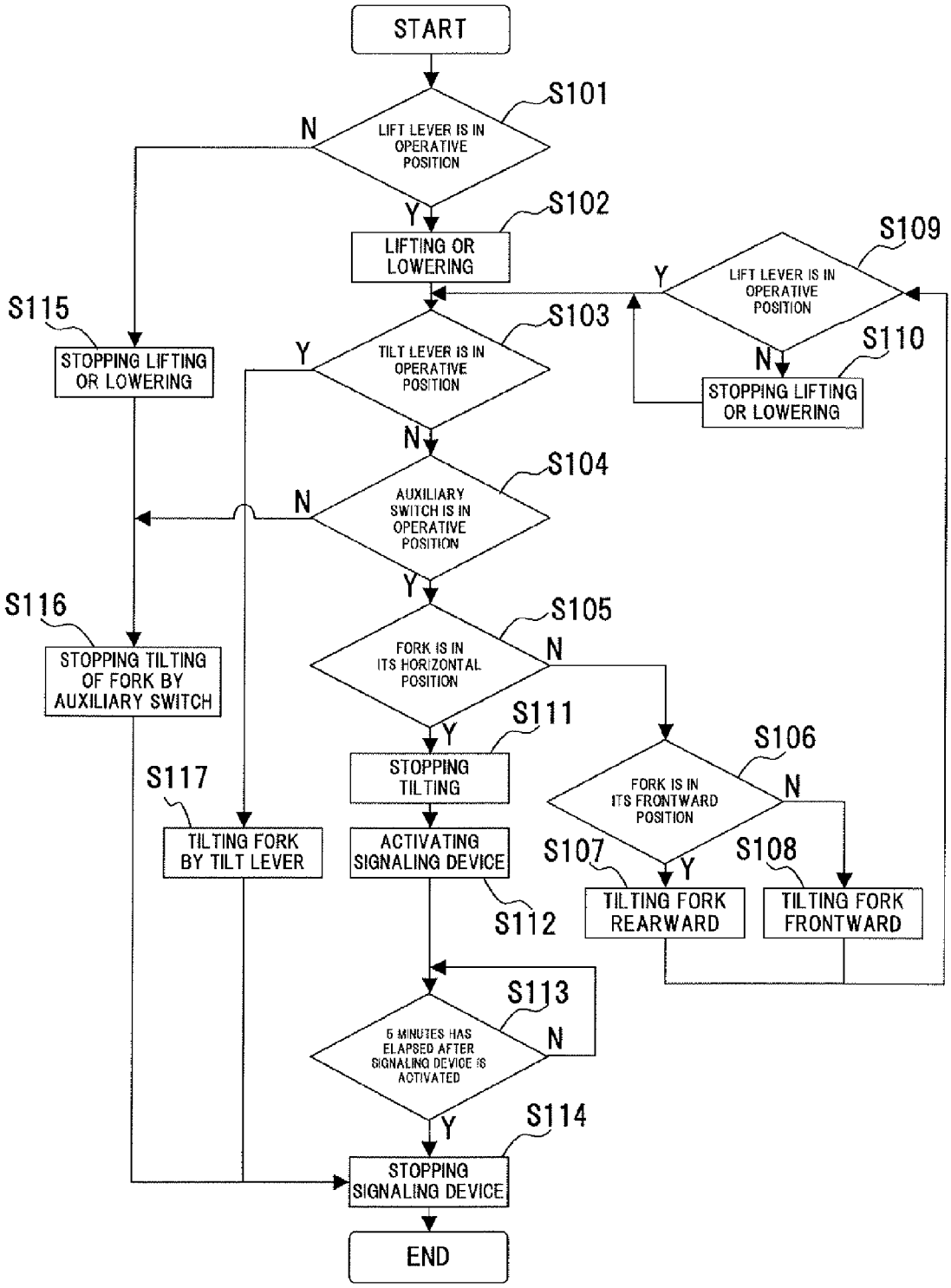
FIG. 5 is a flow chart illustrating the operation of the automatic fork leveling function of a forklift truck according to a second preferred embodiment of the present invention.

The following will describe a second preferred embodiment of the present invention with reference to FIG. 5. The second preferred embodiment differs from the first preferred embodiment in that a part of the automatic fork leveling function or the second program is modified. According to the second preferred embodiment, the controller 74 stores therein a third program for the automatic fork leveling function instead of the second program of the first preferred embodiment.

The rest of the structure of the second preferred embodiment is substantially the same as that of the first preferred embodiment. In the following description of the second preferred embodiment, the same reference numerals denote the same or similar elements or components to the first preferred embodiment, and the description thereof will be omitted.

The following will describe the operation of the automatic fork leveling function or the third program of the second preferred embodiment with reference to FIG. 5. Receiving a detection signal from the lifting operation detector 66, the controller 74 determines at step S101 whether or not the lift lever 50 is in operative position. If YES at step 101, the controller 74 causes the fork 30 to be lifted or lowered at step 102. The fork 30 is lifted or lowered depending on the operation of the lift lever 50 by the operator. If NO at step S101, the process proceeds to the end.

Receiving a detection signal from the tilting operation detector 62, the controller 74 determines at step S103 whether or not the tilt lever 40 is in operative position. If NO at step S103, the controller 74 determines whether or not the auxiliary switch 52 is in operative position at step S104. If YES at step 104, the lift lever 50 and the auxiliary switch 52 are in operative position and the controller 74 determines at step S105 whether or not the fork 30 is in its horizontal position based on a detection signal from the tilt angle detector 70. If NO at step S105, the controller 74 determines at step S106 whether or not the fork 30 is tilted frontward.

On the other hand, If YES at step S105, the controller 74 controls the tilting mechanism 60 to tilt the fork 30 rearward at step S107. If NO at step S106, the controller 74 controls the tilting mechanism 60 so as to tilt the fork 30 frontward at step S108 and the process proceeds to step S109.

The controller 74 determines at step S109 based on a detection signal from the lifting operation detector 66 whether or not the lift lever 50 is in operative position. If YES at step 109, the process proceeds to step S103.

On the other hand, if NO at step S109, it is determined by the controller 74 based on a detection signal from the lifting operation detector 66 that the lift lever 50 is not in operative position, or the operation of the lift lever 50 is stopped, and the controller 74 controls the lifting mechanism 64 so as to stop the lifting or lowering of the fork 30. In this case, the tilting operation by the tilting mechanism 60 at step S107 or step S108 continues. The lifting or lowering operation of the fork 30 is stopped, but the tilting operation by the tilting mechanism 60 continues.

Thus, when the lift lever 50 and the auxiliary switch 52 are in operative position and the automatic fork leveling function is being performed, only the lifting or lowering operation of the lift lever 50 is stopped. While the auxiliary switch 52 is in operative position, the lifting operation of the fork 30 by the lifting mechanism 64 is stopped, but the tilting operation of the fork 30 continues. Then, the process returns to step S103. Thereafter, while the auxiliary switch 52 is in operative position, the operation of step S103 through step S110 are repeated until YES determination is made at step S105, or until it is detected at step S105 based on a signal from the tilt angle detector 70 that the fork 30 is placed in its horizontal position. If YES at step S105, the controller 74 controls the tilting mechanism 60 so as to stop the tilting operation of the fork 30 frontward or rearward at step S111. When the lift lever 50 is in inoperative position and the auxiliary switch 52 is in operative position, the tilting mechanism 60 continues to tilt the fork 30 based on a signal from the tilt angle detector 70 until the fork 30 is brought to its horizontal position.

When the fork 30 is tilted to its horizontal position, the signaling device 72 is activated to notify the operator at step S112 that the fork 30 has been tilted to its horizontal position. Then, the controller 74 determines at S113 whether or not a predetermined length of time, e.g. 5 minutes, has elapsed after the signaling device 72 is activated. If YES at step S113 (or 5 minutes has elapsed after the signaling device 72 is activated), the signaling device 72 is stopped at step S114 and the process goes to the end. Thus, the fork 30 is placed in its horizontal position and, then the operator may perform the loading operation.

The process is returned to step S101 and the steps of operation are performed repeatedly.

While the process from the step S103 to the step S109 is repeatedly performed, if YES determination is made at step S103, or if it is determined based on a signal from the tilting operation detector 62 that the tilt lever 40 is in operative position, the fork 30 is tilted frontward or rearward at step S117 and the process goes to step S114.

If NO determination is made at step S104, or it is determined based on a signal from the lifting operation detector 66 that the lift lever 50 is in inoperative position while the steps S103 through S109 are performed repeatedly, the process goes to step S116. If it is determined based on a signal from the lifting operation detector 66 that the lift lever 50 is in inoperative position or the operation of the lift lever 50 is stopped at step S104, the controller 74 controls the process to step S116. If NO determination is made at step S109 while the steps S101 through S109 are performed repeatedly, the lifting or lowering of the fork 30 at step S110 is stopped and then the process goes to step S103.

The forklift truck 1 of the second preferred embodiment offers the same advantageous effects as the first preferred embodiment.

If NO determination is made at step 109, or the operation of the lift lever 50 is stopped, when the fork 30 is tilted to its horizontal position while the fork 30 is being lifted and lowered during the repeated performance of steps S103 through S109, only the lifting or lowering operation of the fork 30 is stopped, but the operation of the fork 30 being tilted to its horizontal position continues. When the fork 30 is tilted toward its horizontal position while the fork 30 is being lifted or lowered, the fork 30 may be tilted to its horizontal position if the lifting or lowering distance of the fork 30 is small.

The present invention is not limited to the embodiments described above, but it may be modified into alternative embodiments as exemplified below. According to the first and second preferred embodiments of the present invention, the fork 30 is controlled to be tilted to its horizontal position relative to the ground by the automatic fork leveling function. However, the present invention is not limited to such structure. The fork 30 may be controlled so as to be tilted to a position that is within a range of a few degrees, for example ±5 degrees, from the horizontal position, depending on the operation by the operator.

According to the first and second preferred embodiments of the present invention, the auxiliary switch 52 is made of a switch which is kept closed only while the switch is held pressed. However, the auxiliary switch 52 may be of an alternate type switch which is closed and opened alternately each time the switch is pushed.

According to the first and second preferred embodiments of the present invention, a buzzer is used as the signaling device 72. Alternatively, a vibration generator, a sound generator, an illumination generator or any other device which may cause the operator to recognize that the fork has reached a predetermined angle position may serve as the signaling device 72.

According to the first preferred embodiment of the present invention, the determination of whether or not the auxiliary switch 52 is in operative position is made at step S4 after the determination of whether or not the lift lever 50 is operative position at step S1. Alternatively, the steps S1 and S4 of the first embodiment may be reversed, that is the step S1 may be performed after the step S4. Furthermore, these steps may be performed at the same time. The same is true of the second preferred embodiment.

What is claimed is:

1. A forklift truck including a truck body, a fork and a mast movable to be lifted, lowered and tilted together with the fork, the forklift truck comprising:

a tilting mechanism adapted to tilt the mast relative to the truck body;

a tilt lever adapted to operate the tilting mechanism;

a tilting operation detector adapted to detect whether or not the tilt lever is in an operative position;

a lifting mechanism adapted to lift and lower the fork along the mast;

a lift lever adapted to operate the lifting mechanism;

a lifting operation detector adapted to detect whether or not the lift lever is in an operative position;

an auxiliary switch disposed on the lift lever at a position where the auxiliary switch and the lift lever are operable by the same hand of an operator of the forklift truck;

a tilt angle detector adapted to detect a tilt angle of the mast; and a controller adapted to control the tilting mechanism and the lifting mechanism based on signals from the tilting operation detector, the lifting operation detector and the auxiliary switch, wherein when the auxiliary switch is in an operative position and the lift lever is in an operative position, the controller controls the tilting mechanism so as to tilt the fork to have a predetermined tilt angle based on a signal from the tilt angle detector, wherein when the lift lever is placed in an inoperative position from a state where the auxiliary switch is in an operative position and the lift lever is in an operative position, the controller controls the lifting mechanism so as to stop the lifting or the lowering of the fork and the controller controls the tilting mechanism so as to stop the tilting of the fork, and when the auxiliary switch is placed in an inoperative position from a state where the auxiliary switch is in an operative position and the lift lever is in an operative position, the controller controls the lifting mechanism such that the operation of the fork being lifted or lowered continues and the controller controls the tilting mechanism so as to stop the tilting of the fork.

2. A forklift truck including a truck body, a fork and a mast movable to be lifted, lowered and tilted together with the fork, the forklift truck comprising:

a tilting mechanism adapted to tilt the mast relative to the truck body;

a tilt lever adapted to operate the tilting mechanism;

a tilting operation detector adapted to detect whether or not the tilt lever is in an operative position;

a lifting mechanism adapted to lift and lower the fork along the mast;

a lift lever adapted to operate the lifting mechanism;

a lifting operation detector adapted to detect whether or not the lift lever is in an operative position;

an auxiliary switch disposed on the lift lever at a position where the auxiliary switch and the lift lever are operable by the same hand of an operator of the forklift truck;

a tilt angle detector adapted to detect a tilt angle of the mast; and a controller adapted to control the tilting mechanism and the lifting mechanism based on signals from the tilting operation detector, the lifting operation detector and the auxiliary switch, wherein when the auxiliary switch is in an operative position and the lift lever is in an operative position, the controller controls the tilting mechanism so as to tilt the fork to have a predetermined tilt angle based on a signal from the tilt angle detector, wherein when only the lift lever is placed in an inoperative position from a state where the lift lever is in an operative position while the auxiliary switch is in an operative position, the controller controls the tilting mechanism such that the operation of the fork being tilted to have a predetermined tilt angle continues.

3. The forklift truck according to claim 1, wherein the forklift truck further includes a signaling device adapted to notify the operator, the signaling device is activated when the mast is tilted to have a predetermined tilt angle relative to the truck body.

4. The forklift truck according to claim 2, wherein the forklift truck further includes a signaling device adapted to notify the operator, the signaling device is activated when the mast is tilted to have a predetermined tilt angle relative to the truck body.

* * * * *